United States Patent [19]

Baker

[11] Patent Number: 4,969,588

[45] Date of Patent: Nov. 13, 1990

[54] ADJUSTABLE REEL THREADER FOR PARTIALLY FINISHED LOGS OF DIFFERING DIAMETERS

[76] Inventor: Burle E. Baker, 405 Mission Rd., Palatka, Fla. 32077

[21] Appl. No.: 368,805

[22] Filed: Jun. 20, 1989

[51] Int. Cl.[5] ..... B65H 20/14; D21F 1/42

[52] U.S. Cl. ..... 226/91; 226/95; 226/97; 242/65; 162/193; 162/286

[58] Field of Search ..... 226/91, 7, 95, 97; 242/65, 66; 162/193, 283, 286; 34/117, 120

[56] References Cited

U.S. PATENT DOCUMENTS

| | | | |
|---|---|---|---|
| 1,676,305 | 7/1928 | Weldon | 34/18 |
| 2,622,492 | 12/1952 | Goodwillie | 226/91 X |
| 2,714,840 | 8/1955 | Bayrer et al. | 226/91 X |
| 2,776,605 | 1/1957 | McAfoos | 226/91 X |
| 3,265,267 | 8/1966 | Wallin | 226/91 |
| 3,265,320 | 8/1966 | Johnson | 226/91 X |
| 3,908,924 | 9/1975 | Schulze | 242/56 R |
| 4,014,487 | 3/1977 | Reba et al. | 226/91 X |
| 4,022,366 | 5/1977 | Rooney | 226/91 |
| 4,147,287 | 4/1979 | Reba | 226/91 X |
| 4,186,860 | 2/1980 | Reba | 226/91 |
| 4,429,819 | 2/1984 | Palovaara | 226/91 X |
| 4,467,950 | 8/1984 | Karlsson et al. | 226/91 |
| 4,513,517 | 4/1985 | Vedenpää | 226/91 X |
| 4,684,443 | 8/1987 | Kepttula et al. | 226/97 X |
| 4,726,502 | 2/1988 | Cryderman | 226/97 |
| 4,726,532 | 2/1988 | Holm | 242/65 |
| 4,763,822 | 8/1988 | Mohrsen | 226/91 |

*Primary Examiner*—Stuart S. Levy
*Assistant Examiner*—Steven M. duBois
*Attorney, Agent, or Firm*—Frank H. Foster

[57] ABSTRACT

A reel threader for treading the tail of a paper making web around a partial reel. A flexible panel with interior passages forming an air distribution network has openings on one surface to provide a plurality of air streams out of the surface. The panel is positioned by a computer controlled movable support frame in an arc which is spaced from and concentric with the lower and side portion of a partial reel, regardless of its diameter, to form a gap. The tail passes from the nip into the gap and is pulled through the gap by the rotating periphery of the partial reel.

7 Claims, 3 Drawing Sheets

ADJUSTABLE REEL THREADER FOR PARTIALLY FINISHED LOGS OF DIFFERING DIAMETERS

TECHNICAL FIELD

This invention relates generally to the manufacture of paper and more particularly relates to an adjustable threader for threading a tail onto the reel, regardless of its effective diameter, for winding a parent roll upon a spool.

BACKGROUND ART

In the continuous, mass production of paper, a continuous web of paper is formed, pressed and dried and then wound into finished logs at the reel. The web advances continuously at a high rate of speed through the production line and into the horizontal winding reel where it is wound upon spools into discrete logs for later processing.

When starting a new roll on an empty core or spool, the paper web is easily adhered to the metal surface of the new roll by wetting the surface. In this manner the end of the web is easily adhered to the roll, wound around to make the first winding layer, after which the web is pulled against itself and held securely as further windings accumulate.

Occasionally, however, a problem or defect occurs upstream in the production line which causes the web to break when a core is only partially completed. In conventional paper production this results in a time consuming and costly procedure to thread the web through the machine and secure it to the partial reel.

In particular, after the upstream problem or defect is corrected, a new tail is formed which must be threaded into the reel and around the spool or core. A tail is a narrow strip having a width which is controlled by a squirt on the forming fabric. After the tail is properly threaded onto the partial reel, the tail is progressively widened until it reaches the full width of the web.

In a conventional reel, the reel drum pivots against the spool or core. The tail and eventually the full width web passes down through the nip between the drum and the spool, underneath and around and then over the top of the spool and back through the nip. The principal problem in threading the reel is to convey the tail down around the bottom and up over the top of the spool because gravity tends to pull the tail away from that portion of the spool.

In the conventional papermaking production line, a worker must physically go down beneath the spool with an air hose and blow the tail around, underneath and over toward the top of the partially filled spool. This procedure is both a danger to the worker and results in considerable down time for the production line. Typically this down time is in the range of 15 minutes to an hour.

It is therefore an object of the present invention to increase the safety of the paper making operation and at the same time reduce the production line down time.

A great variety of systems have been used for guiding or threading a web through paper manufacturing machinery. These include the rope systems in which rope belts are used for guidance, vacuum-belt systems in which a vacuum draws the web against a porous belt which delivers the tail or web to the desired position and air tube threaders in which an air blast from fixed pipes blows a tail or web against a roll. Other systems use air foils or the Coanda effect to entrain air and draw the web against the roll. None of these, however, have been satisfactory for guiding a web, such as a paper tail, beneath and up around to the top of a rotating, partial reel upon which it is to be wound.

BRIEF DISCLOSURE OF INVENTION

The invention is a flexible panel which is formed with an air passage network to distribute air under pressure around in the panel. The air passage network is connected to a suitable air supply. One of the major surfaces of the panel is formed with a plurality of outlet ports which are connected to the air passage network for directing air streams away from that major surface. In operation the major surface of the flexible panel, which has the outlet ports, is positioned so that it is spaced from and inwardly facing toward the roll so that the air streams are directed generally toward the roll. Because the panel is a flexible sheet, it may be shaped and positioned in a contour so the operable portion of the flexible panel is substantially cylindrical in shape and concentric with the rotating roll to maintain a relatively uniform gap between the panel and the periphery of the roll regardless of the diameter of the partially finished reel. The tail is inserted down through the nip and is directed into the gap between the flexible panel and the rotating spool. The flexible panel holds the tail against the partially filled spool and the rotation draws it around through the gap and to the nip.

Figure 1:
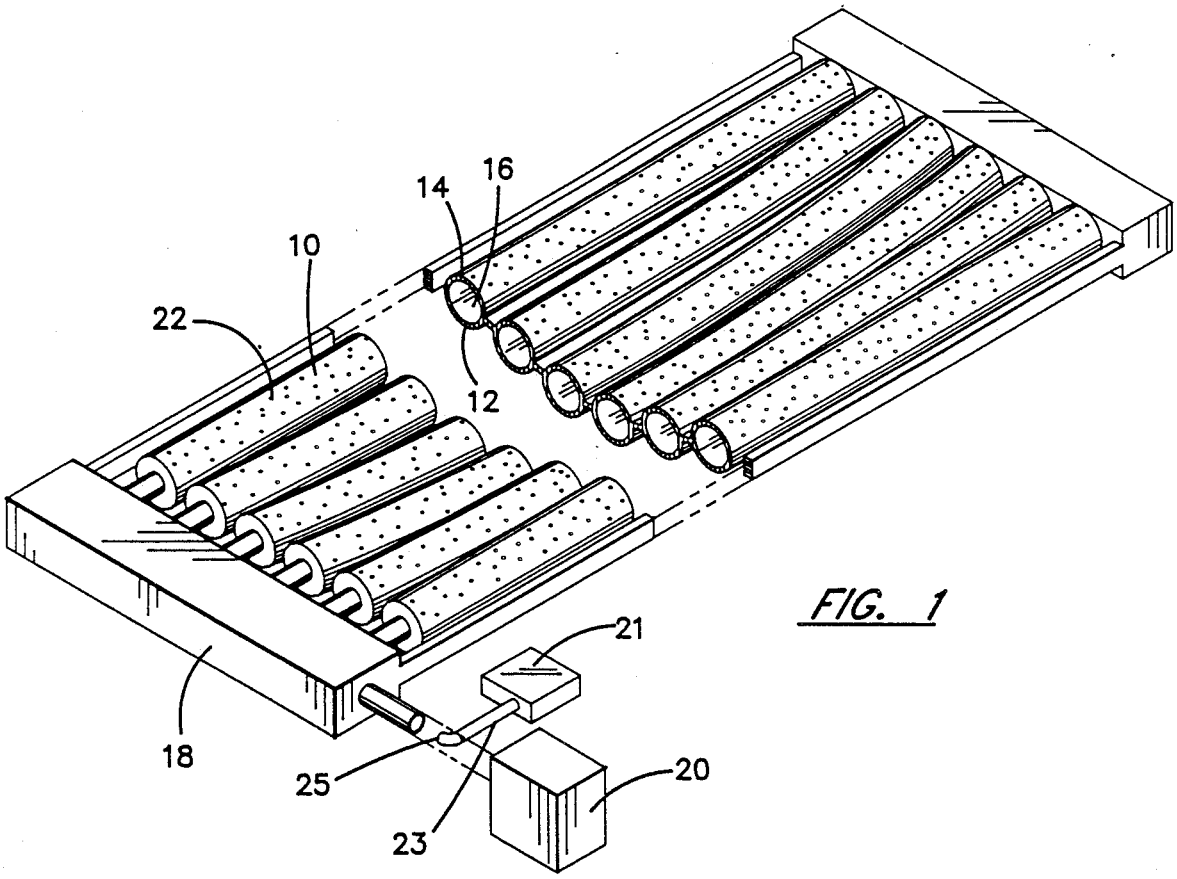
FIG. 1 is a view in perspective of a flexible panel as used in the preferred embodiment of the invention with a segment removed to reveal its interior cross section.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION

FIG. 1 illustrates a flexible panel 10 formed in accordance with the present invention. The flexible panel 10 is formed with an air passage network for distributing air under pressure around the interior of the panel. The panel is advantageously formed in a manner similar to the construction of an air mattress. It comprises two laminated layers 12 and 14 which are formed of air impervious, flexible sheet material. These sheets are bonded together, for example by heat welding, in a manner which leaves a pattern of unbonded regions, such as region 16, to form the distribution network. The preferred pattern is a plurality of contiguous, parallel, longitudinal passageways.

A manifold 18 is physically connected along one edge of the flexible panel and is connected in air communication to the air distribution network of the flexible panel 10. The manifold is in turn connected to an air supply, shown diagrammatically as 20. Desirably, water from a water source 21 can be conveyed through a pipe 23 to be sprayed from a nozzle 25 into the air stream. This allows a small amount of moisture to be sprayed onto the log 42, described below, to improve adherence of the tail if that is needed. The water supply can be turned on and off as desired by a solenoid controlled water valve.

The outlet ports may simply be formed by numerous perforations, such as perforation 22, formed through the sheet 14 of the two laminated sheets which will face the paper roll.

Figure 3:
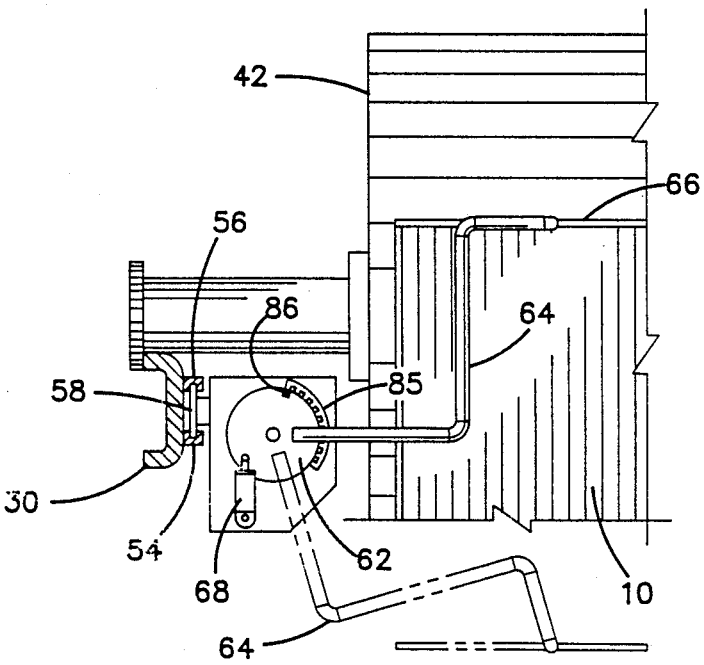
FIG. 3 is an end view of a portion of the embodiment illustrated in FIG. 2.
Figure 2:
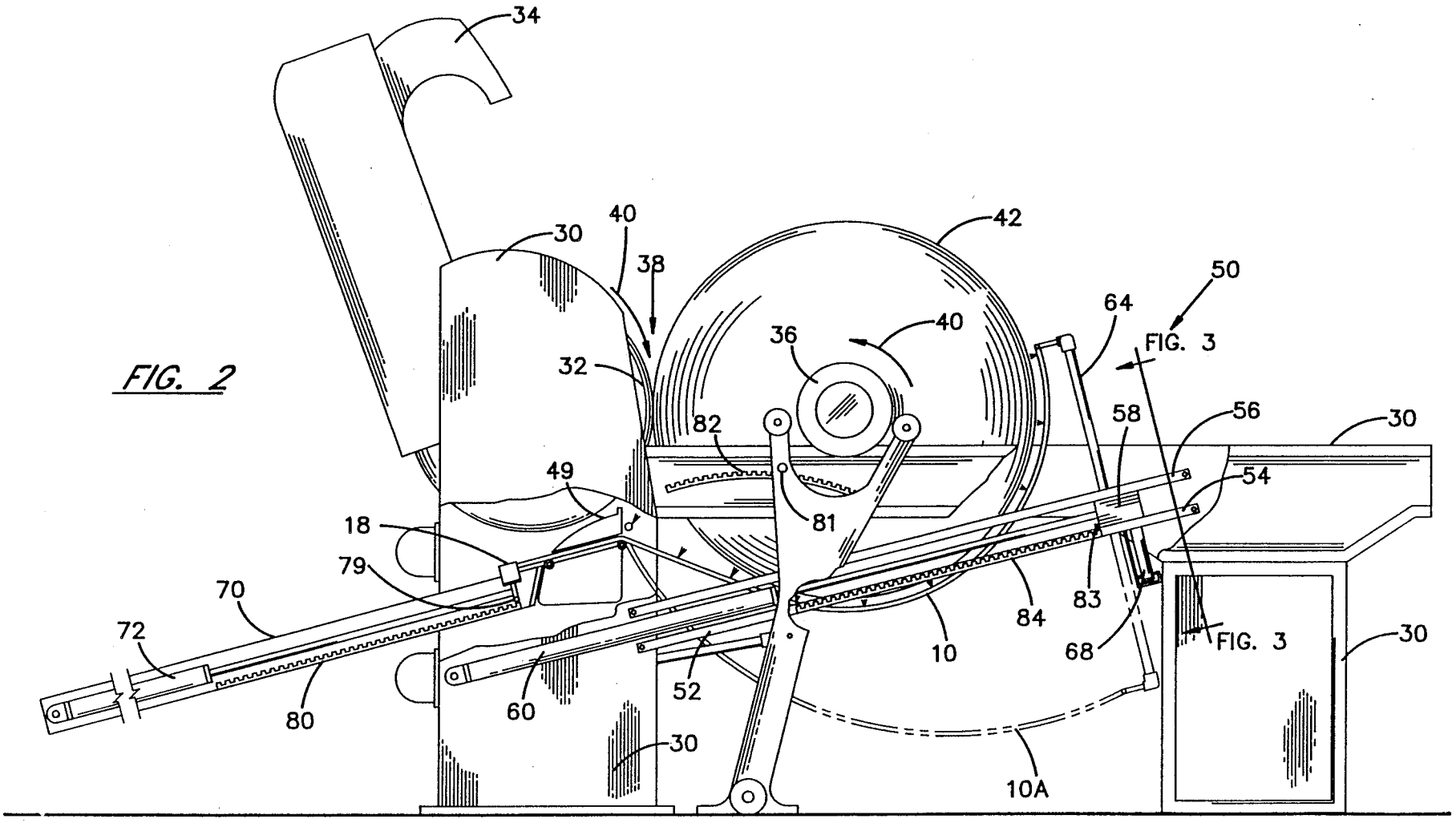
FIG. 2 is a view in side elevation of a horizontal reel upon which is mounted a preferred embodiment of the invention and having segments of the conventional reel removed to reveal the structure of the invention.

FIGS. 2 and 3 illustrate the principal elements of a conventional reel to which the preferred embodiment of the invention is attached. The conventional reel has a support body 30 to which the drum 32 and other conventional rollers are journalled. The reel is provided with a pair of primary arms, only arm 34 being visible, which, in the conventional operation, hold the primary spool and moves it to its secondary spool position 36 when it is partially filled. As is well known to those skilled in the art, the web of paper, as it is wound upon the spool 36, passes through a nip 38 and about the spool 36 as shown by the arrows 40 until it again passes through the nip 38. As the web is wound and accumulated on the spool 36, the spool diameter increases and its central axis of rotation moves away from the drum 32. A nearly finished log is shown as 42.

The flexible panel 10, which is illustrated in FIG. 1, extends from the manifold 18 through the doctor blade holder 44 and droops beneath the partial reel 42 and then extends upwardly partially around the opposite side of a partial reel 42.

Although the flexible panel 10 may be positioned manually about the lower portion of the partial reel 42, it is preferred that the flexible panel be supported on a movable support frame, designated generally as 50, which moves it to the selected position about a portion of the partial roll 42. The preferred support frame has a first arm 52 which consists of parallel slotted tracks 54 and 56 having slots facing towards each other to receive opposite sides of a carriage 58 formed by a rectangular plate which slides in the slots. A first prime mover in the form of a first air cylinder 60 is connected to the carriage 58 to translate it a controlled and selected distance along the tracks 54 and 56 in a direction which is generally parallel to a tangent of the partial reel 42.

A second carriage 62, formed by a rotatable disk is rotatably mounted to the first carriage 58. The second carriage 62 is fixed to a support arm 64 which is attached to the end 66 of the flexible panel 10 which end 66 is along the opposite edge from the manifold 18. The second carriage 62 is connected to a second prime mover 68 which selectively positions the support arm 64 in order to raise and lower the edge of the flexible panel 10.

The air manifold 18 preferably is formed into a carriage which slides along a track 70 being driven by a third prime mover formed by an air cylinder 72. The air manifold is preferably spaced from and generally parallel to the spool or partial reel and preferably reciprocates toward and away from the partial reel 42 to permit more or less of the flexible panel 10 to droop about the partial reel 42.

In the operation of the preferred embodiment, the partial reel may be as small as spool 36, which has just been moved into position by the primary arms 34, or as large or larger than the partial reel 42. In order to thread the tail as it passes downwardly through the nip 38 so that it travels around beneath the reel 42 and up over its top, the flexible panel 10 must be positioned in a substantially arcuate contour so that it is spaced from and so that its operable portion is substantially concentric with the periphery of the partial reel 42. Air is forced under so pressure through the perforations in the panel 10 and a tail or web is fed down through the nip 38 into the gap between the panel 10 and the periphery of the roll 42.

In its most crude form the flexible panel can be manually held by two workmen and pulled into the desirable position. In the preferred alternative, the flexible panel is supported at its ends by any of a variety of possible movable support frames which provide the necessary degrees of movement to position the panel 10 in the concentric position described above.

The support frame may itself be manually moved into the appropriate described position or preferably may be driven by prime movers as illustrated in FIGS. 2 and 3.

Figure 4:
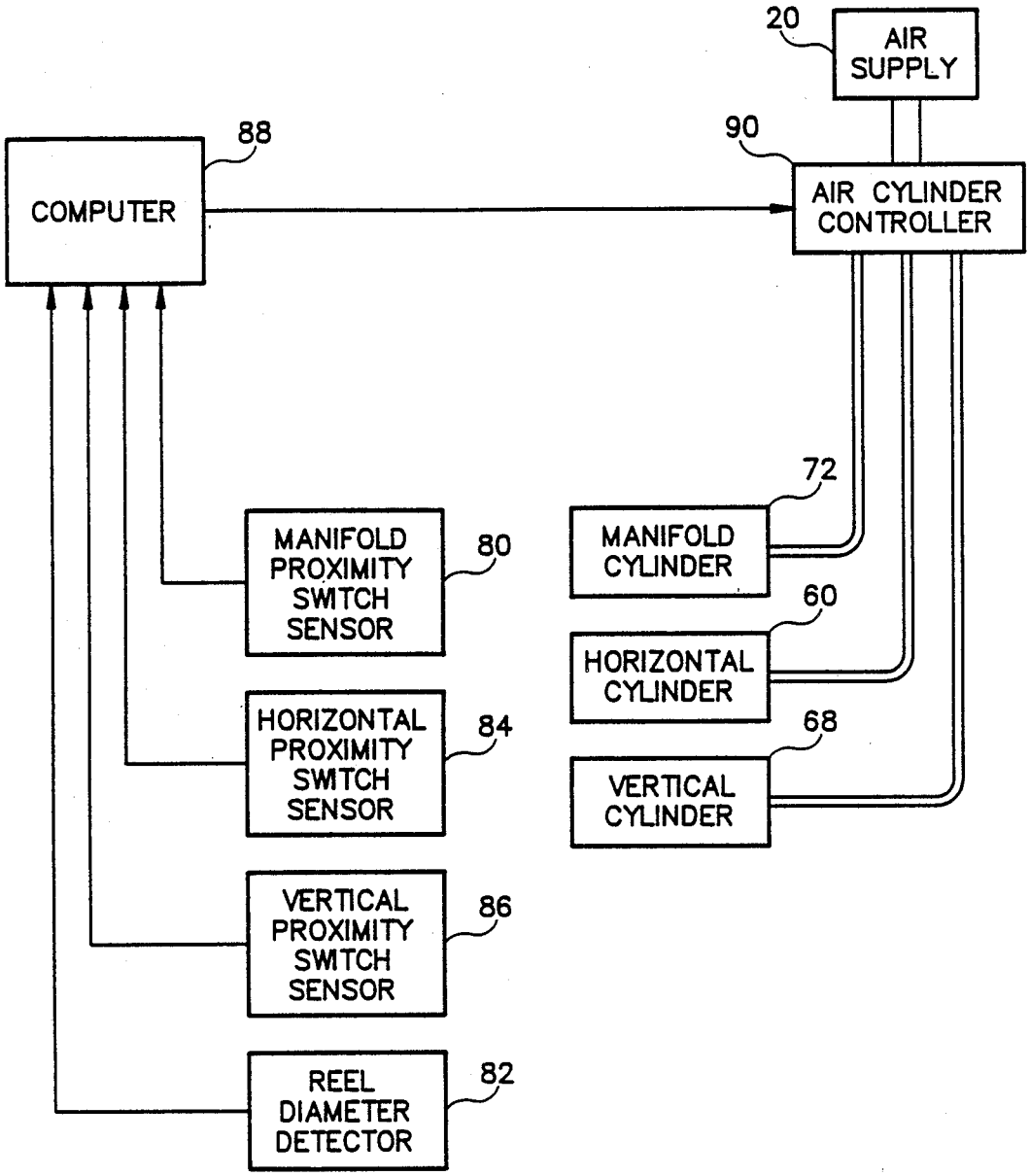
FIG. 4 is a block diagram illustrating the control system of the present invention.

The prime movers may, of course, be manually controlled by conventional valves in the manner well known in the art of pneumatic systems. Thus, a worker may visually position the panel in the desired position as described above. However, as illustrated in FIG. 4 it is preferable to provide a series of position sensors or proximity switches to detect the positioning of each of the carriages which have been described above and to detect the diameter of the partial reel 42. Of course, a variety of proximity detectors may e used including a plurality of microswitches which lie along the path of a cam arm extending from each carriage or along the path of a portion of the core of the partial reel 42 so that the particular switch being contacted indicates the position. Preferably, however, the proximity switches are as illustrated diagrammatically, for example, as proximity switches 79, 81 and 83 in FIG. 2 and 86 in FIG. 3. These switches move along a series of protruding teeth 80, 82, 84, and 85 respectively. They detect position in the conventional manner, for example by computer circuitry which counts the detected pulses to determine position. The input data from these switches is connected to a computer 88, the outputs of which are in turn connected to an air cylinder controller 90 for directing the position of the air cylinders.

The computer is entirely conventional and its operation will be apparent to those familiar with the fundamentals of computer operation. It can, for example, be programmed to have a look up table in memory arranged according to the detected roll diameter. For example, the entire range of possible roll diameters may be subdivided into small incremental ranges. For each detected diameter range an operator may appropriately position the carriages of the movable support frame and these positions will be placed in the memory in association with the radius range. This can be repeated so that there is associated with each radius range a set of positions for each prime mover.

Thereafter detection of a radius will cause the computer to look up the range in which that radius falls and to direct the air cylinder controller to move all cylinders to the positions associated with that radius range.

In the alternative, mathematical equations may be determined for the positioning of the movable support frame. These will provide suitable algorithms which may be processed by the computer for each detected reel diameter.

As a result of the present invention the flexible panel 10 may be held out of the way of the manufacturing process at its position 10*a*, until such time as it is needed. When a tail is to be threaded and attached to a partial reel, the computer will detect the reel diameter and immediately move the flexible panel into the appropriate position about the partial reel. The air supply may be energized and the tail may be immediately fed in the manner illustrated in FIG. 2. Thus, the entire threading operation can be accomplished in less than a minute without the necessity for a workman to position himself within or beneath the machinery.

While certain preferred embodiments of the present invention have been disclosed in detail, it is to be understood that various modifications may be adopted without departing from the spirit of the invention or scope of the following claims.

I claim:

1. An adjustable threader for guiding the end of a flexible web around a rotating roll which is journalled to a supporting body, the threader comprising:

(a) a flexible panel formed with an air passage network to distribute air under pressure around the panel, the panel having one of its major surfaces spaced from and inwardly facing toward the roll and formed with a plurality of outlet ports connected to the air passage network for directing air streams generally towards the roll;

(b) an air supply connected to said air distribution network; and (c) a movable support frame means attached to the panel for moving it into a selected position about a portion of the roll.

2. A threader in accordance with claim 1 wherein said air supply includes a manifold which is connected to the flexible panel along one edge of the flexible panel and is connected to the air distribution network and wherein the movable support frame means is attached to the flexible panel along its opposite edge.

3. A threader in accordance with claim 2 wherein said manifold is radially spaced from and generally parallel to said roll and wherein said movable support frame means moves the opposite edge of the panel in radial and tangential direction components to a selected position radially spaced from the roll.

4. A threader in accordance with claim 3 wherein said support frame means more particularly comprises:

(a) a first arm parallel to a tangent of the roll with a first carriage mounted for movement along said first arm by a first prime mover;

(b) a second carriage attached to said opposite edge of the flexible panel, mounted to said first carriage and movable by a second prime mover to raise and lower said opposite edge of the panel; and (c) a third carriage movable tangentially of the roll by a third prime mover and attached to said manifold.

5. A threader in accordance with claim 4 wherein a proximity sensor means is mounted to said supporting body for detecting the diameter of a roll and supplying electronic data at its output and wherein an electronic computer has a data input connected to said sensor means and outputs connected to the controls of said prime movers for positioning the flexible panel about the roll.

6. A reel threader from guiding the end of a tail of a paper web around a spool and directing it toward the nip between a paper winding spool and a drum, the threader comprising:

(a) a flexible panel comprising at least two flexible, air impervious, laminated sheets which are bonded together except for a pattern of unbonded regions forming an air passage network to distribute air under pressure around the panel, one of the major surfaces of the panel being spaced from and facing inwardly towards the spool and having a plurality of perforations through the flexible sheet at the distribution network regions for directing air jets towards the spool;

(b) an air supply including a manifold spaced from and generally parallel to the spool and connected to the air distribution network along one edge of the panel; and (c) a movable support frame means attached along the opposite edge of the panel for moving the opposite edge radially and tangetially of the spool to a selected position and contour for the panel.

7. A threader in accordance with claim 6 wherein said support frame means particularly comprises:

(a) a first arm parallel to a tangent of a roll with a first carriage mounted for movement along said first arm by a first prime mover;

(b) a second carriage attached to said opposite edge of the flexible panel, mounted to said first carriage and movable by a second prime mover to raise and lower said opposite edge of the panel; and (c) a third carriage movable tangentially of the roll by a third prime mover and attached to said manifold.

* * * * *